US009568272B2

(12) United States Patent
Grace, Jr.

(10) Patent No.: US 9,568,272 B2
(45) Date of Patent: Feb. 14, 2017

(54) MAGNETIC DROP-AWAY ARROW REST

(71) Applicant: Grace Engineering Corp., Memphis, MI (US)

(72) Inventor: Louis Grace, Jr., North Street, MI (US)

(73) Assignee: Grace Engineering Corp., Memphis, MI (US)

( * ) Notice: Subject to any disclaimer, the term of this patent is extended or adjusted under 35 U.S.C. 154(b) by 0 days.

(21) Appl. No.: 15/155,370

(22) Filed: May 16, 2016

(65) Prior Publication Data

US 2016/0341512 A1 Nov. 24, 2016

Related U.S. Application Data

(60) Provisional application No. 62/165,437, filed on May 22, 2015.

(51) Int. Cl.
*F41B 5/22* (2006.01)
*F41B 5/14* (2006.01)

(52) U.S. Cl.
CPC ..... *F41B 5/143* (2013.01)

(58) Field of Classification Search
CPC ..... F41B 5/143
See application file for complete search history.

(56) References Cited

U.S. PATENT DOCUMENTS

| | | | | |
|---|---|---|---|---|
| 5,503,136 | A | 4/1996 | Tone | |
| 6,688,296 | B1 * | 2/2004 | Greywall | F41B 5/143 124/44.5 |
| 6,688,297 | B1 | 2/2004 | Clague | |
| 7,311,099 | B2 | 12/2007 | Rager | |
| 7,597,095 | B2 | 10/2009 | Grace, Jr. et al. | |
| 8,279,032 | B1 | 10/2012 | Fullerton et al. | |
| 8,941,455 | B2 | 1/2015 | Alexander et al. | |
| 2011/0018665 | A1 | 1/2011 | Fullerton et al. | |
| 2014/0208543 | A1 * | 7/2014 | Fullerton | B42F 1/00 16/273 |

* cited by examiner

*Primary Examiner* — John Ricci
(74) *Attorney, Agent, or Firm* — Warner Norcross and Judd, LLP

(57) ABSTRACT

A drop away arrow rest includes programmable or coded magnets that selectively move an arrow support arm to predetermined positions, such as a support position to hold an arrow, or a rest position to move out of the way of an arrow as it is launched from an archery bow.

20 Claims, 14 Drawing Sheets

MAGNETIC DROP-AWAY ARROW REST

BACKGROUND OF THE INVENTION

The present invention relates to arrow rests, and more particularly to magnetically actuated arrow rests and related methods of operation.

Most archery bows are equipped with an arrow rest that holds an arrow before it is shot from the bow. One common arrow rest is referred to as a "drop away" arrow rest. This rest precisely and accurately positions the arrow when the bow (and thus, the bowstring) is at full draw, but drops rapidly away from the arrow upon release of the bowstring. Accordingly, as the arrow is shot from the bow, the rest does not contact the arrow for its full length or the arrow's fletching, which would otherwise divert the arrow from its intended trajectory.

A variety of drop away arrow rests exist. One type of rest is a forward falling rest. This type of rest includes an arrow support that rotates forward and downward, moving from a loaded or cocked position to a relaxed position. Another type of a drop-away arrow rest is a C-axis rest. An example of this is the C-Max arrow rest offered by G5 Outdoors, LLC of Memphis, Mich. This type of rest includes an arrow support that rotates in a plane orthogonal to an axis of an arrow supported by the arrow support. Another type of drop-away rest is a falling block rest that moves linearly downward when the arrow is launched to provide vane clearance for the arrow.

Conventional arrow rests are actuated via the interaction of mechanical structures, such as spring-systems and cords that are attached to cables of the bow. While this provides generally consistent operation, sometimes the mechanical parts, particularly the springs, can fail due to excessive wear and/or friction. Further, the parts of the various mechanisms can become worn so that tolerances are no longer acceptable and the rests do not consistently fall, or do not consistently return to a loaded state.

Some drop-away arrow rests have been constructed using conventional magnets. An example is U.S. Pat. No. 6,688,297 to Clague. In this construction, the fall-away arrow rest is constructed like a teeter totter. One magnet attracts a first metal tab to hold the arrow rest in an up position. When the forward moving arrow slides on the shaft support, it exerts a mechanical force that overcomes the magnetic force holding the arrow support in an upward position, in which case the arrow support teeter totters forward, out of the way of the arrow which exits the bow. While this arrow rest assists in moving the rest, it is rather large and bulky, and the magnets forward and rearward of the support arms of the teeter totter structure can require fine tuning to consistently drop the arrow rest.

Although there are a number of drop-away arrow rests on the market, there remains room for improvement to provide consistently operating, wear resistant, uncomplicated mechanisms to launch arrows from an archery bow.

SUMMARY OF THE INVENTION

A drop-away arrow rest is provided to include a programmable or "coded" magnet that selectively moves an arrow support arm to predetermined positions to consistently and properly launch an arrow from an archery bow.

In one embodiment, the arrow rest includes one or more magnetic elements that include a coded magnet. The coded magnet includes a fixed plurality of maxels having individual polarities and strengths. These maxels cooperatively emit a first magnetic field profile that exerts a predetermined force, for example, a predetermined magnetic force, from the first magnetic element. This predetermined force can be utilized to orient and/or reorient the magnetic elements relative to other components of the arrow rest and/or bow, thereby moving the rest to or from a support position and/or a rest position.

In another embodiment, the arrow rest can include first and second magnetic elements disposed adjacent one another, so that one or both is located in a magnetic field profile of the other or both. One of the magnetic elements can be non-rotatably joined with an arrow support arm of the arrow rest. The other can be joined with another component of the rest that does not move with the arrow support arm. Optionally, in operation and use, the first and second magnetic elements never physically contact one another.

In still another embodiment, at least one of the magnetic elements can exert the magnetic field profile on the other magnetic element to reposition the arrow support arm. For example, when the bow is drawn, the arrow support arm can be positioned in a support position that is configured to support an arrow. Alternatively, the magnetic field profile and its associated predetermined force can be used to position the arrow support arm in a rest position, out of the way of the arrow as it is shot or launched from the bow.

In yet another embodiment, the arrow rest can be a forward falling arrow rest. It can include an axle to which an arrow support arm is mounted. The arrow support arm can be rotatable about a rest axis that is generally perpendicular to an arrow when mounted on the arrow support arm.

In even another embodiment, the arrow rest can be a C-axis rest. The support arm can rotate about an axle and/or rest axis that is generally parallel to an axis of an arrow when the arrow is supported by the arrow support arm in the support position.

In a further embodiment, the arrow rest can be a vertically falling arrow rest. The arrow support arm can be movable in a substantially vertical plane. The magnetic elements can be configured to urge the arrow support arm from the support position linearly and vertically downward to a rest position.

In still a further embodiment, the arrow rest can be actuated via the spatial orientation of the magnetic elements relative to one another, for example, when the first magnetic element becomes misaligned with a second magnetic element, or alternatively aligned with the second magnetic element. More particularly, when one magnetic element rotates relative to a second magnetic element, the respective magnetic field profile of the first magnet can become misaligned with the second magnetic element. Thus, the predetermined force asserted by the first magnetic element on the second magnetic element no longer holds the arrow rest in the support position or the rest position, depending on the movement of the rest.

In still a further embodiment, the arrow rest can include a biasing element, for example, a coil spring. The coil spring can be joined with the support arm and/or axle. This coil spring can urge the support arm toward the support position and/or the rest position. The coil spring can urge the support arm in a direction that is the same or opposite of that direction which the predetermined force of the magnetic element urges the arrow support arm. Thus, the force of the spring and the predetermined force of the magnetic element can act in concert or can oppose one another.

In a further embodiment, the arrow rest can include first and second magnetic elements. Both can include respective coded magnets that have respective maxels, each magnet exerting respective magnetic field profiles. These magnetic profiles can cooperate to enhance a predetermined force on the arrow support arm, thereby moving it into the support position and/or the rest position, depending on their relative orientation.

The arrow rest of the current embodiments provides a consistently functioning, programmable, highly tunable arrow rest. The arrow support arm can be efficiently and consistently moved from a rest position to a support position and vice versa. With the coded magnets, the overall number of structural moving parts can be reduced, as well as the propensity for mechanical wear and tear.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
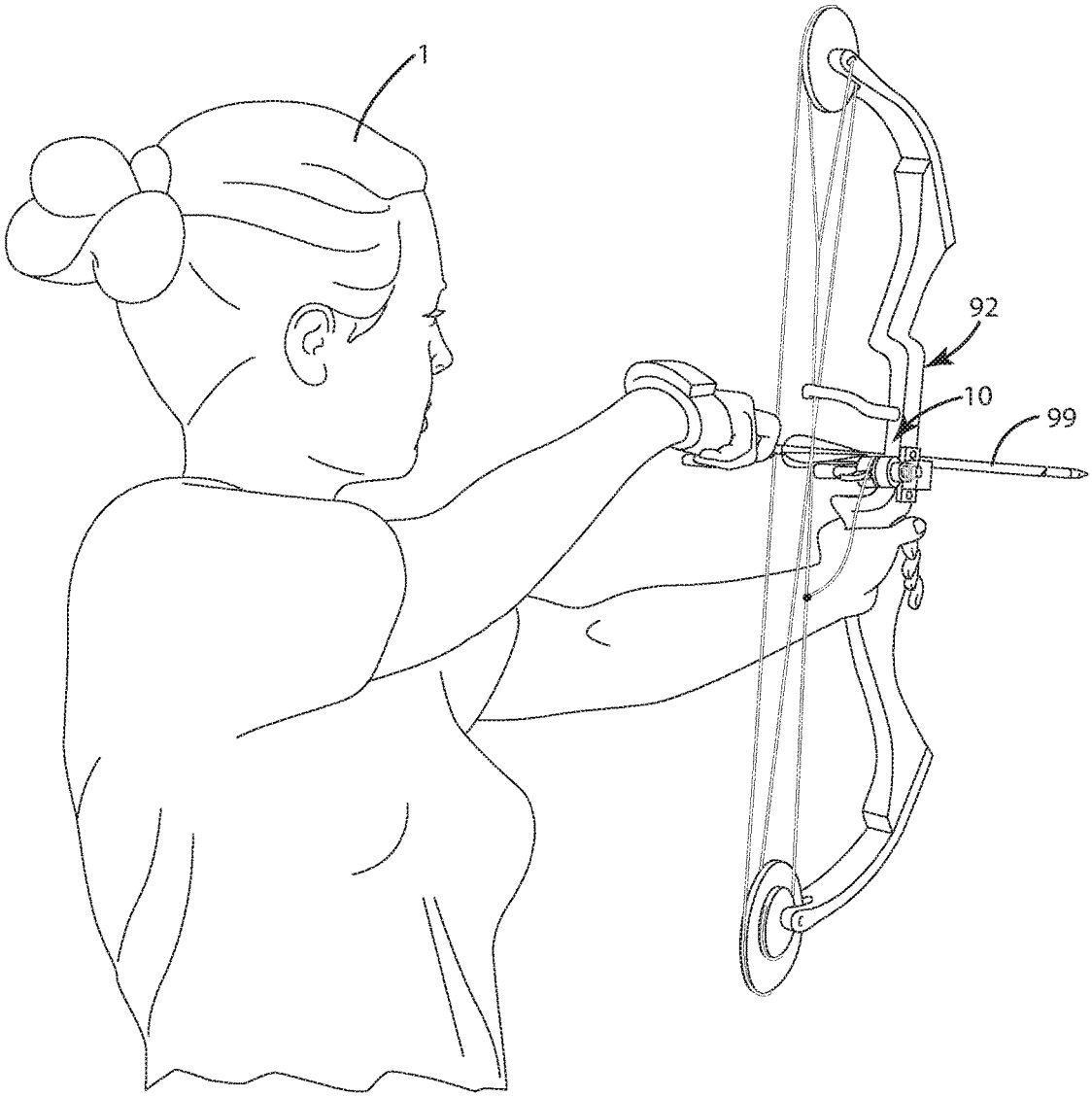
FIG. 1 is a perspective view of an archery bow including an arrow rest of a current embodiment, the bow being at brace (undrawn)

A drop away arrow rest constructed in accordance with a current embodiment is illustrated in FIGS. 1-5 and generally designated 10. The drop away arrow rest is mounted to a bow 90 and in particular a bow riser 92. The rest can be mounted with a bracket 11 which can include features enabling the arrow rest to be adjusted for windage and/or elevation by manipulating and/or moving fasteners within respective slots (not shown).

In general, the rest 10 is configured so that its support arm 20 can capture and support an arrow 99. The support arm 20 is actuatable and moveable from the rest position shown in FIG. 2 to the support position shown in FIG. 5 via operation of first and second magnetic elements 31 and 32. The first magnetic element 31 can exert a predetermined force PF1 on the second magnetic element 32, which in this embodiment can be a ferrous material 32M disposed in or on or associated with the second magnetic element. Optionally, the ferrous material 32M can be in the form of a plate. In this case, the ferrous material can be considered to be the second magnetic element.

Figure 2:
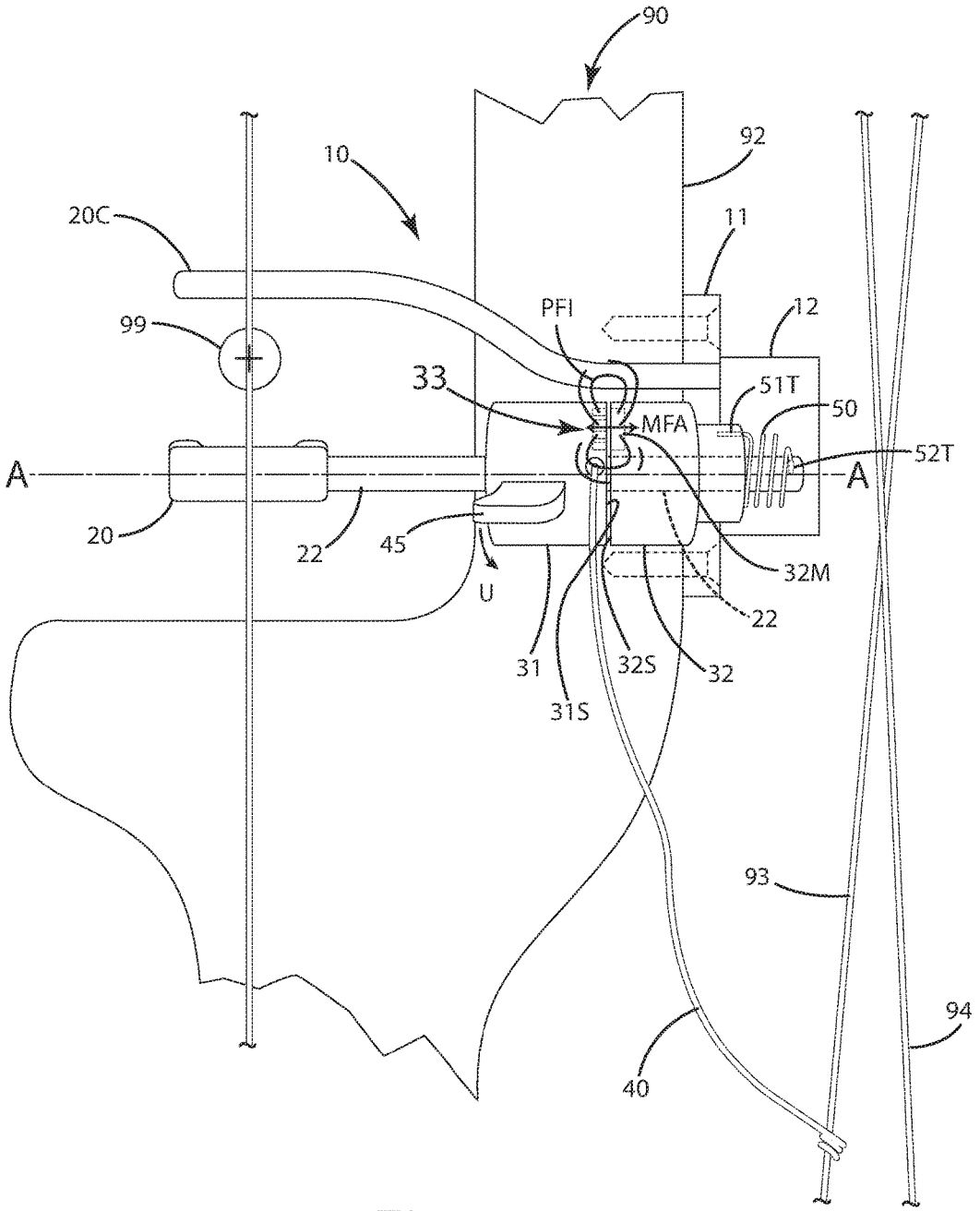
FIG. 2 is a rear view of the arrow rest before the bow is drawn, with a magnetic element maintaining the support arm in a rest position.

The first magnetic element can be fixedly and non-rotatably joined with an axle 22, which optionally can be further non-rotatably and fixedly joined with the support arm 20. The first magnetic element 31 can exert the predetermined force PF1 on the second magnetic element 32, for example, the ferrous material 32M, which in turn magnetically attracts and maintains the ferrous material into a particular spatial orientation relative to the first magnetic element. With this magnetic predetermined force, exerted by the first magnetic element 31, on the second magnetic element 32, the first magnetic element maintains the support arm 32 in the rest position as shown in FIG. 2, particularly when no other external forces are exerted upon the first magnetic element, the axle 22 and/or the support arm 20. Optionally, the magnetic predetermined force can be an attractive (or repulsive) magnetic force generated by a magnetic field exerted by the first magnetic element on the ferrous material.

Figure 4:
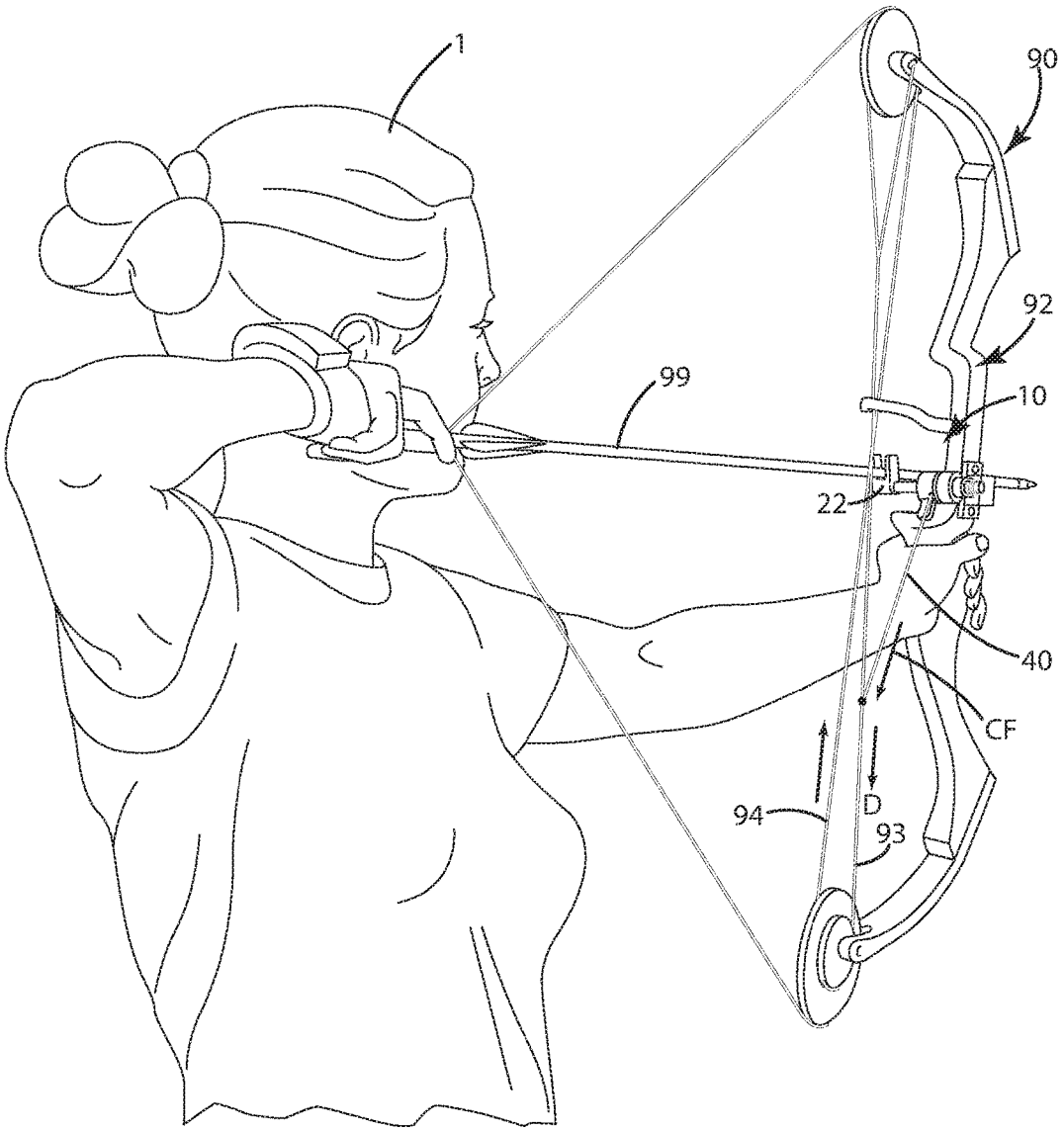
FIG. 4 is a perspective view of the support arm of the arrow rest in a support position when the archery bow is fully drawn.
Figure 5:
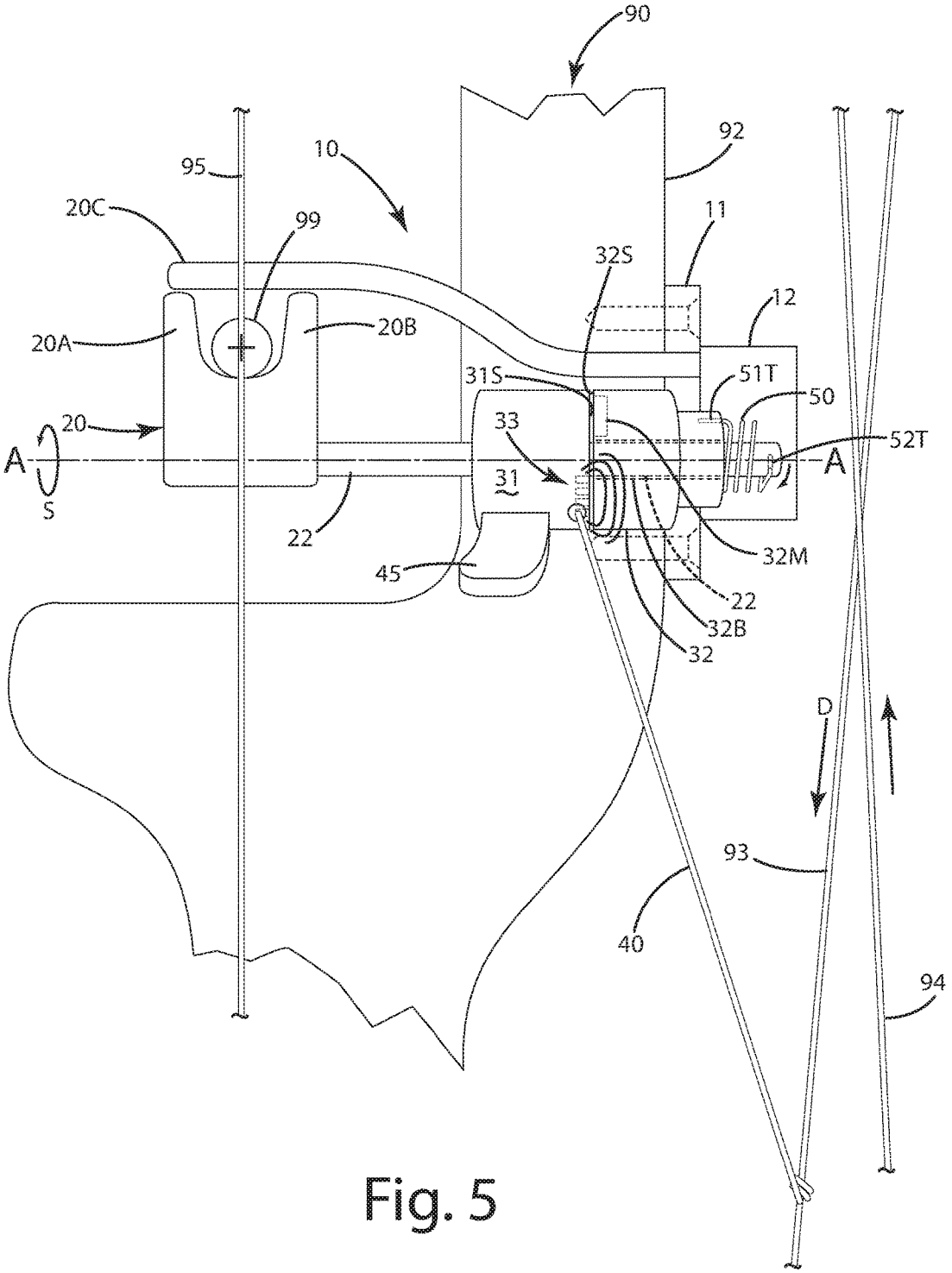
FIG. 5 is a rear perspective view of the support arm of the arrow rest in a support position when the archery bow is fully drawn.
Figure 6:
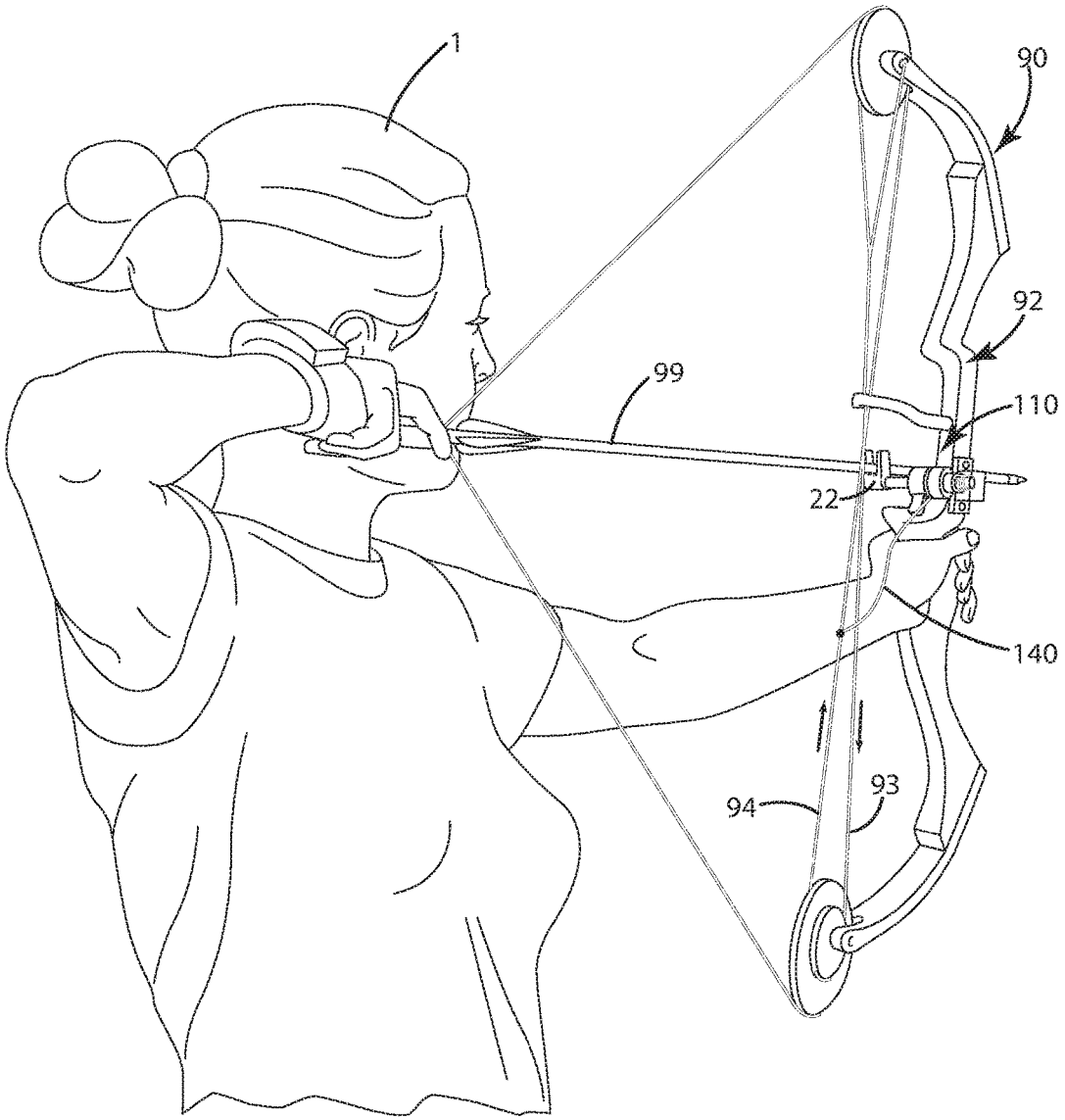
FIG. 6 is a perspective view of a fully drawn archery bow including an arrow rest of a first alternative embodiment.

To counter the predetermined force PF1 in FIG. 2 and return the support arm 20 to a support position, for example, as shown in FIG. 5, a portion of the arrow rest 10 can be joined via a connector with another bow component that moves as the archery bow 90 is drawn and/or released. As shown in FIG. 2, the first magnetic element 31 can be tethered via a connector 40 to a power cable 93 of the bow 90. This power cable optionally can be a power cable that moves downward when the bow is drawn, but of course can be the power cable that moves upward depending on the application. In FIG. 2, the bow is in an undrawn state. Thus, when an archer draws the bow as shown in FIGS. 4 and 5, the power cable 93 moves downward in the direction of the arrow D. This exerts a force, referred to as a cord force CF, or tension through the connector 40. The cord force CF is sufficient to overcome the predetermined force PF1 exerted by the first magnetic element 31 on the second magnetic element 32, thereby allowing the support arm 20, the axle 22 and the associated first magnetic element 31 to rotate in the direction of the arrow S up to the support position shown in FIG. 5. In support position, the support arm need not be perfectly vertically or at 90° relative to a horizontal plane passing through the rest axis A. Optionally, it can be offset at some angle of 70°-90° from the horizontal plane, tilting slightly forward relative to the vertical plane. In turn, this supports the arrow 99 in the ready-to-shoot position when the archery bow 90 is fully drawn.

The connector 40 mentioned above can be attached to a portion of the axle, the support arm and/or first magnetic element 50 so as to effectively move and/or rotate the support arm to a variety of positions, including the support position and the rest position. Although shown as attached to the down cable 93, the cord 40 can be attached at its opposite end to any movable bow component, such as an upper, lower or other bow limb, a cam axle, an up cable, a down cable, a cable slide, or any other component of the bow that might move as the bow is drawn and/or shot. Although referred to as a "cord" this term is meant to encompass any type of connector, such as a string, wire, web, rubber band, hydraulic, solid or other linkage joined with a desired bow component, such as the limb, axle, up or down cables or any other moveable components of the bow. Generally, the cord is adapted to increase or decrease in tension when the bow components move, which in turn effects movement of the support arm optionally via the axle, the magnetic elements or some other component fixed to or joined with the support arm.

Figure 3:
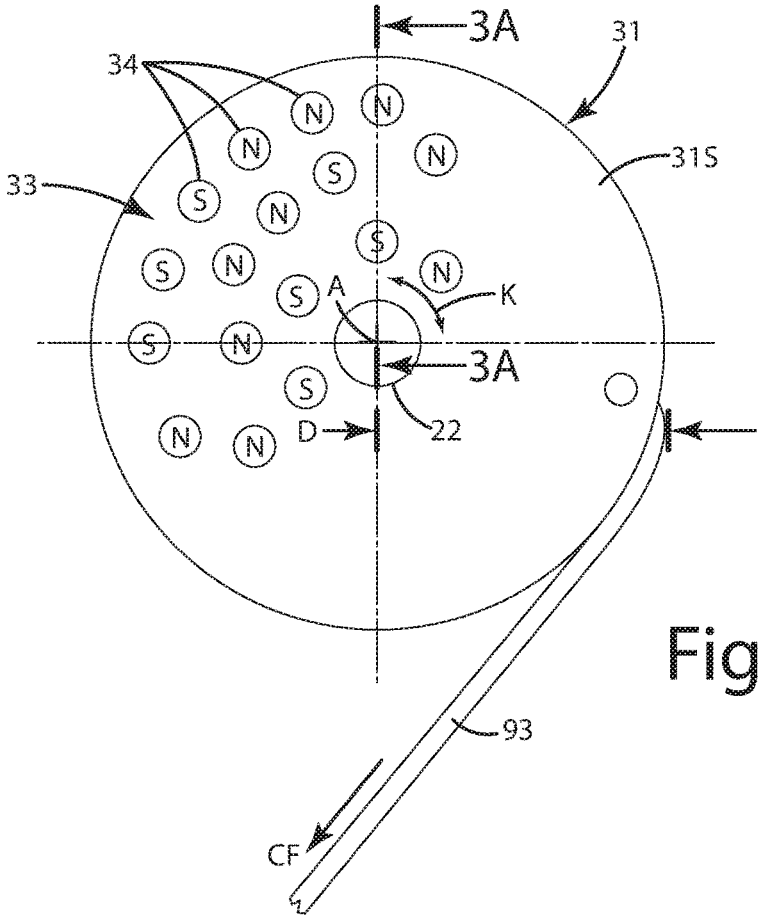
FIG. 3 is an end view of a magnetic element illustrating the coded magnet and multiple maxels thereof.

Optionally, the cord 40 can be joined with the first magnetic element 31. As shown in FIGS. 2 and 3, the point of attachment of the cord to the magnetic element 31 can be offset a distance D from the rest axis A. This is so that when a cord force CF is placed on the power cable 93, it will rotate the first magnetic element and thus the support arm in a direction K about the axis A. Generally, the cord 40 is attached so that when placed under a cord force CF, it can create a moment arm having a length that is the distance D to effectively allow the power cable and cord to rotate the first magnetic element 31.

Optionally, to further capture the arrow 99 when the bow is in the fully drawn state, the arrow rest 10 can include a containment arm 20C that extends upwardly and generally over the support arm 20 and respective prongs 20A and 20B, when the arrow is in the support position as shown in FIG. 5. Of course, the containment arm 20C can be deleted from the construction depending on the particular application.

Cooperatively, the support arm 20, the respective prongs 20A, 20B and the containment arm 20C can form an envelope, which generally surrounds the arrow 99, 360° around the arrow as shown in FIG. 5 when the arrow is in the support position. With this envelope formed, the arrow can be fully contained within the arrow rest. Therefore, accidental or unintentional dislodgement of the arrow from the support arm is impaired and/or prevented.

As shown in FIGS. 2 and 5, the rest 10 can include an axle 22 extending generally laterally away from the bracket 11, toward the bowstring 95 and the bowstring plane within which it moves. The support arm 20 can be centered in that bowstring plane. The axle 22 can extend laterally, away from the support arm 20 and at least partially into an optional housing 12. The housing 12 can contain a portion of the axle 22 so that the axle can rotate relative to the housing 12, and thus the bracket 11 to which the housing is fixedly secured. Optionally, the axle 22 can be rotatably joined with the housing 12 and/or the bracket via bearings, bushings or other structures that allow the axle 22 to rotate freely relative to the bracket and/or housing.

As shown in FIG. 5, the housing 12 and/or bracket 11 can be fixedly and non-rotatably joined with the second magnetic element 32. The second magnetic element thus can be non-rotatable relative to the bracket and/or housing. The axle, however, can be configured so that it rotates through and/or within a bore 32B (FIG. 5) defined by the second magnetic element 32. Of course, the magnetic element 32 can be incorporated directly into the housing and/or bracket 11, so that no bore is utilized. Instead, the second magnetic element 32 can be fixed to one of these elements and non-rotatable relative to the axle and/or the first magnetic element 31. Optionally, in some cases, the second magnetic element 32 can be slightly rotatable within a predetermined range of rotation, for example, 1° to about 15°. This can vary, depending on the particular coded magnets that are used in the construction.

Generally, the axle 22, support arm 20 and magnetic element 31 are all fixedly and non-rotatably attached to one another. With such attachment, all of these elements rotate in unison relative to one another. All of these components, when transitioning from the support position shown in FIG. 5 to the rest position shown in FIG. 2 or vice versa, can rotate relative to the second magnetic element 32, as well as the optional housing and/or the bracket 11. Optionally, in some constructions, the support arm can be rotatably adjustable relative to the axle and/or magnetic element to address timing and arrow positioning issues.

Optionally, the arrow rest 10 can include a biasing element 50. The biasing element can be in the form of a coil spring, however, it can be replaced with any other spring construction, such as a leaf spring, an elastomeric element or other biasing structure. In some embodiments, the spring can also be absent from the construction. Generally, the spring 50 includes tangs 51T and 52T that are positioned within holes defined by the housing 12 and/or second magnetic element 32, which is fixedly joined with the housing or bracket. For example, the first tang 51T can be engaged in a hole defined by the second magnetic element 32. The other tang 52T can be is disposed in a hole defined by the axle 22. The coil spring can be configured so that when the axle 22 is rotated from a base or reference orientation, the biasing member or coil spring 50 returns and/or assists the axle 22 to return to that reference orientation.

For example, the spring shown in FIG. 2 can be configured so that the reference position is such that the biasing element 50 assists the first magnetic element 31 in holding the support arm 20 in the rest position as shown in FIG. 2. When the support arm 20 is advanced or moves to the support position shown in FIG. 5 via the moving power cable 93, the spring coils upon itself. Thus, when the cord force CF in the cord 40 is decreased, the spring 50 assists the magnetic element 31 in returning the support 20 to the down position. Of course, the biasing element 50 can be configured to rotate the support arm in an opposite direction, to create the magnetic predetermined force. For example, the coil spring can be configured to bias the axle 22 and thus the support arm 20 to the support position shown in FIG. 5, and act counter to the predetermined force PF1 generated by the magnetic field profile of the first magnetic element. In general, the biasing element, when optionally included, can either assist or counter the predetermined force in rotating the support arm 20 to the support position shown in FIG. 5 or the rest position shown in FIG. 2—or any other position, depending on the particular application and movement of the support arm.

Optionally, the arrow rest 10 can include a manually operable reset element 45, which is shown as a lever. This lever can be indexed in a particular manner relative to the support arm 20 so that a user can manually engage it with their digits to move the support arm. As illustrated in FIGS. 2 and 5, a user can engage the lever 45, and push it downward in a direction U to assist the support arm being converted from a rest position shown in FIG. 2 to an up position shown in FIG. 5. Although not shown, the arrow rest 10 can include a detent or other locking structure that can enable the support arm 20 to be effectively "locked" in the support position shown in FIG. 5. Suitable constructions include those disclosed in U.S. Pat. No. 6,789,536 to Summers, which is hereby incorporated by reference in its entirety.

The bracket, housing, axle, lever, support and containment arms, when included, can be constructed from a variety of metals, plastics or other synthetic materials or any combinations of the foregoing. Optionally, the components can be constructed using casting, CNC machining and/or injection molding processes.

The first and second magnetic elements 31 and 32 of the arrow rest 10 of the current embodiment can be of a variety of constructions. For example, the first magnetic element 31 can include a programmable or "coded magnet" 33 as shown in FIG. 3. When used herein, coded magnet includes any magnetic assembly including a plurality of discreet individual magnets, which are referred to as maxels. The maxels cooperatively produce a magnetic field profile. The overall magnetic field of the coded magnet, and thus the magnetic force, or predetermined force, that it exerts on other objects or structures, depends on an arrangement of the constituent magnetic elements. Thus, by consistently and systematically positioning maxels within a body of a coded magnet, a magnetic force curve having a specific magnetically attractive and/or magnetically repulsive force when in certain orientations can be generated. A coded magnet can include a maxel pattern that varies in at least two dimensions. Thus, rotational alignment of the coded magnet relative to another magnetic element, for example, a ferrous material or a correlated magnet as described below, may force associated objects such as an axle and/or support arm to rotate and/or otherwise move under the predetermined force generated by the coded magnet and its associated magnetic field. Generally, the coded magnets herein can be formed from a plurality of permanent maxels and/or a plurality of electromagnetic maxels. Other configurations of certain magnets are disclosed in U.S. Pat. No. 8,947,185 to Fullerton, which is hereby incorporated by reference in its entirety.

The second magnetic element 32 can be in the form of a ferrous material 32M that is void of any magnets, but that is still effected by a magnetic field and/or magnetic force exerted upon it by a magnet as disclosed herein. When in this form, the second magnetic element 32 can include a plate constructed from a ferrous material that is disposed in or adjacent the second magnetic element 32. Other portions of the second magnetic element 32 can be constructed from composites or plastics that do not include any ferrous material, nor any magnets, and thus are not attracted to repelled by the first magnetic element 31. Alternatively, the second magnetic element 32 can include its own coded magnet as described in further detail below.

The coded magnet 33 can be configured to exert the predetermined force PF1 only when the second magnetic element 32 and, in particular, the ferrous material 32M, is in a predetermined orientation relative to the fixed coded magnet 33. In turn, this maximizes the attractive forces and/or repulsive forces in the predetermined force PF1 of the first magnetic element to effectively hold that element in a fixed rotational orientation relative to the second magnetic element 32. In which case, the first magnetic element can sufficiently hold the axle and support arm in a fixed rotational orientation in the rest position as shown in FIG. 2, or the support position as described further below.

Figure 3A:
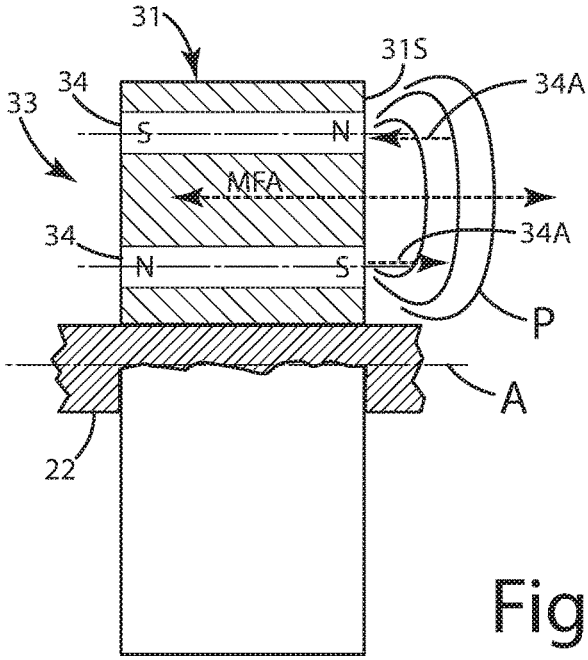
FIG. 3A is a section view further illustrating a magnetic field profile exerted by the maxels taken along lines 3A-3A of FIG. 3.

As shown in FIGS. 2, 3 and 3A, a first surface 31S of the first magnetic element 31 generally faces toward the surface 32S of the second magnetic element 32. The coded magnet 33 can extend along a desired portion of the surface 31S associated with the first magnetic element 31. The first coded magnet 33 can include a plurality of mixed maxels 34, having individual polarities and strengths. Although shown as generally circular shaped, the maxels 34 can be rectangular, polygonal or any other desired cross sectional shape, depending on the application.

The maxels 24 can be positioned and oriented relative to one another to cooperatively generate a magnetic field profile P from the surface 31S of the first magnetic element 31. Accordingly, the individual magnetic fields 34A of the individual maxels 34 combine to present an overall magnetic influence on a ferrous or magnetic object when placed nearby. For example, the magnetic element 32 placed near or within the magnetic field profile P and in particular a ferrous material plate 32M, will result on the coded magnet 33 exerting a magnetic force via the magnetic field profile P on the ferrous material 32M, and corresponding predetermined force PF1. This magnetic predetermined force PF1 maintains the magnetic element 31 in a fixed rotational relationship relative to the second magnetic element 32 and specifically the ferrous material 32M of the second magnetic element 32.

Optionally, as described below, the predetermined magnetic force PF1 also can urge the magnetic element 31 to attain a particular rotational orientation relative to the second magnetic element. The coded magnet 33 can be configured to exert the predetermined force PF1 only when the second magnetic element 32 and, in particular, the ferrous material 32M, is in a predetermined orientation relative to the fixed coded magnet 33. In turn, this maximizes the attractive forces and/or repulsive forces in the predetermined force PF1 of the first magnetic element to effectively hold and/or urge that element in a fixed rotational orientation relative to the second magnetic element 32. In which case, the first magnetic element can sufficiently hold the axle and support arm in a fixed rotational orientation in the rest position as shown in FIG. 2, or the support position as described further below.

Optionally, as shown in FIG. 3A, the individual maxels 34 can include their respective polarities and intensities 34A. The polarities and intensities can be aligned in the magnetic element 31 so as to emanate the magnetic field profile P along or generally parallel to a magnetic force axis MFA. The magnetic force axis MFA in the embodiments illustrated in FIGS. 1-5 is generally oriented parallel to the rest axis A. With this type of orientation, rotation of the axle and support arm about the rest axis is achieved by the predetermined force PF1 exerted through the magnetic field profile P. To maximize the rotation, the maxels can be selectively oriented within the coded magnet 33. The magnetic element 31 can rotate relative to the second magnetic element 32 a predetermined angle at a predetermined rate (e.g. angular acceleration or angular velocity) to provide a desired movement of the support arm 20 to or from the support position and/or rest position.

Optionally, the maxels 24 can be formed by permanent magnets that are fixed to have their desired poles adjacent the surface 31S. As shown in FIGS. 3 and 3A, the maxels 34 can have a first subset of maxels having north polarities and/or a first strength 34A at the surface 31S so as to attract the second magnetic element 32 (or a corresponding coded magnet), and a second subset of maxels 34 having south polarities at the surface 31S of a second strength which can repel the second magnetic element 32. The first strength may be less than the second strength to provide a desired net attractive or repulsive force.

Further optionally, the maxels 34 can be modified so as to change their polarities and/or intensities. If desired, permanent magnets forming the maxels can be optionally pivotable or removable so that the polarity can be changed by pivoting and rotating the maxels 24 180°, or by manually removing, turning and replacing the maxel. In this manner, movement of the arrow rest, that is, movement to the support and/or rest position can be fine-tuned.

Further optionally, the first and second magnetic elements can be configured so that the components of the first magnetic element, for example, the coded magnet, do not directly contact or engage the components of the second magnetic element, for example, the ferrous material or another coded magnet. Generally, the first and second magnetic elements can interact with one another via magnetic fields, and are urged to move relative to one another due to those magnetic fields, optionally without physically contacting one another. Operation of the arrow rest 10 and the bow in general will now be described in reference to FIGS. 1-5. As shown in FIGS. 1 and 2, the arrow rest 10 can be configured with the support arm in the rest position. The predetermined force PF1 exerted by the magnetic field profile P (FIG. 3A) is emitted by the first magnetic element 31 toward the second magnetic element 32 and, in particular, the ferrous material 32M, optionally in the form of a metal plate. This force PF1 holds the support arm 20 in the position shown in FIG. 2. Where included, the optional coil spring 50 can also exert a rotational force on the axle 22 about the rest axis A to assist in holding the support arm 20 in the rest position as well.

When the arrow is drawn, a cord force CF is exerted by the down power cable 93 moving in the direction shown in FIG. 4. As shown in FIGS. 3 and 4, the cord force CF rotates the first magnetic element 31 in a direction K about the rest axis A. In addition, the axle 22 and support arm 20 rotate in that direction. The connector 40 is timed to the down power cable 93 sufficiently so that the arrow rest 20 moves to the support position shown in FIG. 5 when the bow is fully drawn. In this position, the predetermined force PF1 created by the magnetic field profile P is overcome sufficiently via the cord force CF so that the support arm 20 is supported in the support position shown there. In this configuration, the connector 40 is taut. In this configuration, the coil spring 50 also stores energy in it due to the cord force CF rotating the axle, which in turn coils the coil spring 50. The cord force, the transferred through the connector, however, overcomes both the magnetic predetermined force PF1, as well as the optional biasing force of the biasing element 50.

When the bow string is released from the drawn position to fire the arrow, the arrow slides along the support arm 20 a small distance. The connector 40 starts to become loose. The predetermined force PF1 of the first magnetic element 31 exerts an attractive force on the plate ferrous material. This urges the support arm, and axle, which are associated and fixed to the first magnetic element 31, to rotate. This, in turn, moves the rest from the support position shown in FIG. 5 to the rest position as shown in FIG. 2. Optionally, where included, the coil spring 50 can assist in this movement by releasing its stored energy to rotate the axle as well. The process can be repeated for the next arrow placed on the arrow support.

Figure 7:
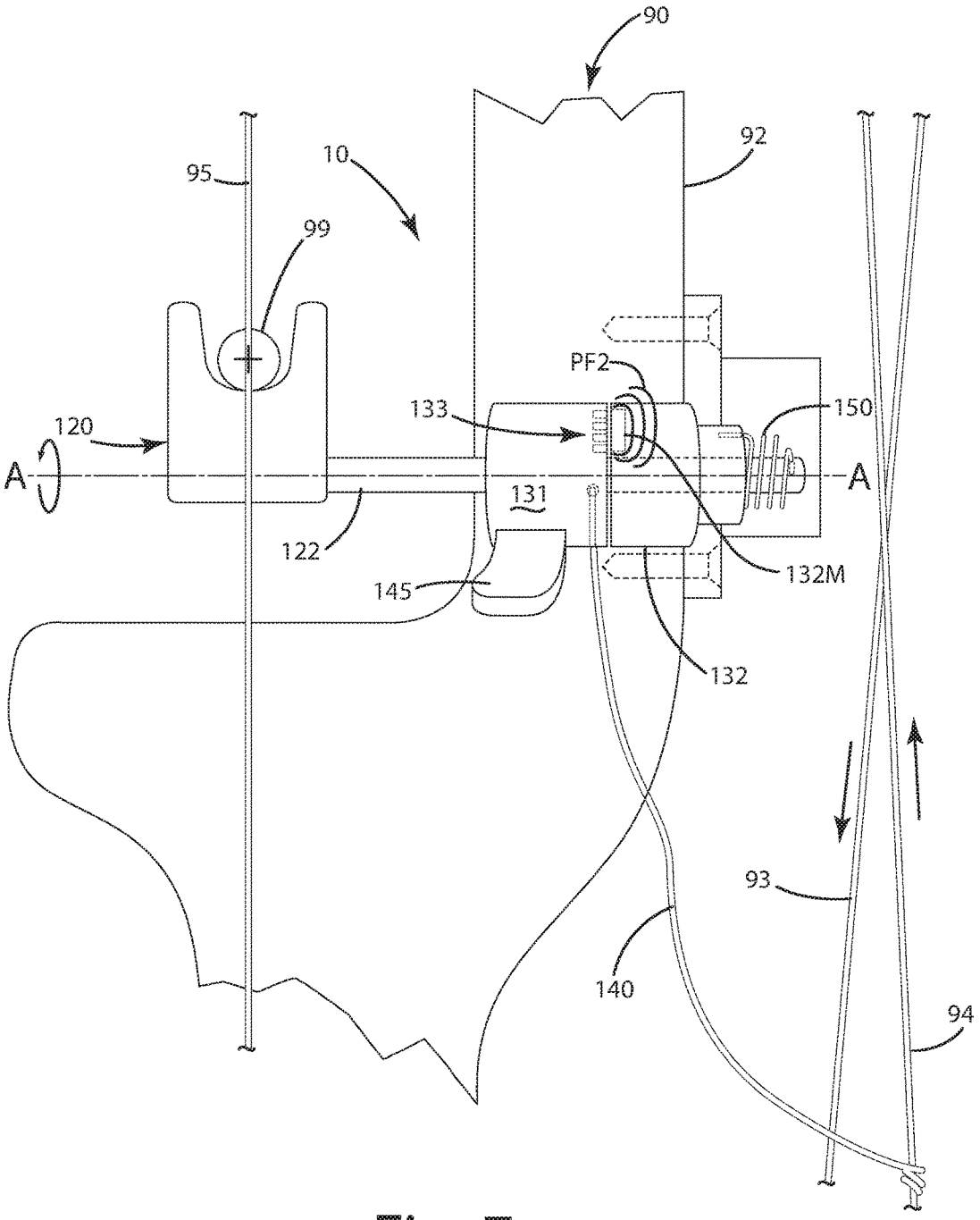
FIG. 7 is a rear perspective view of the support arm of the arrow rest of the first alternative embodiment in a support position when the archery bow is fully drawn.
Figure 8:
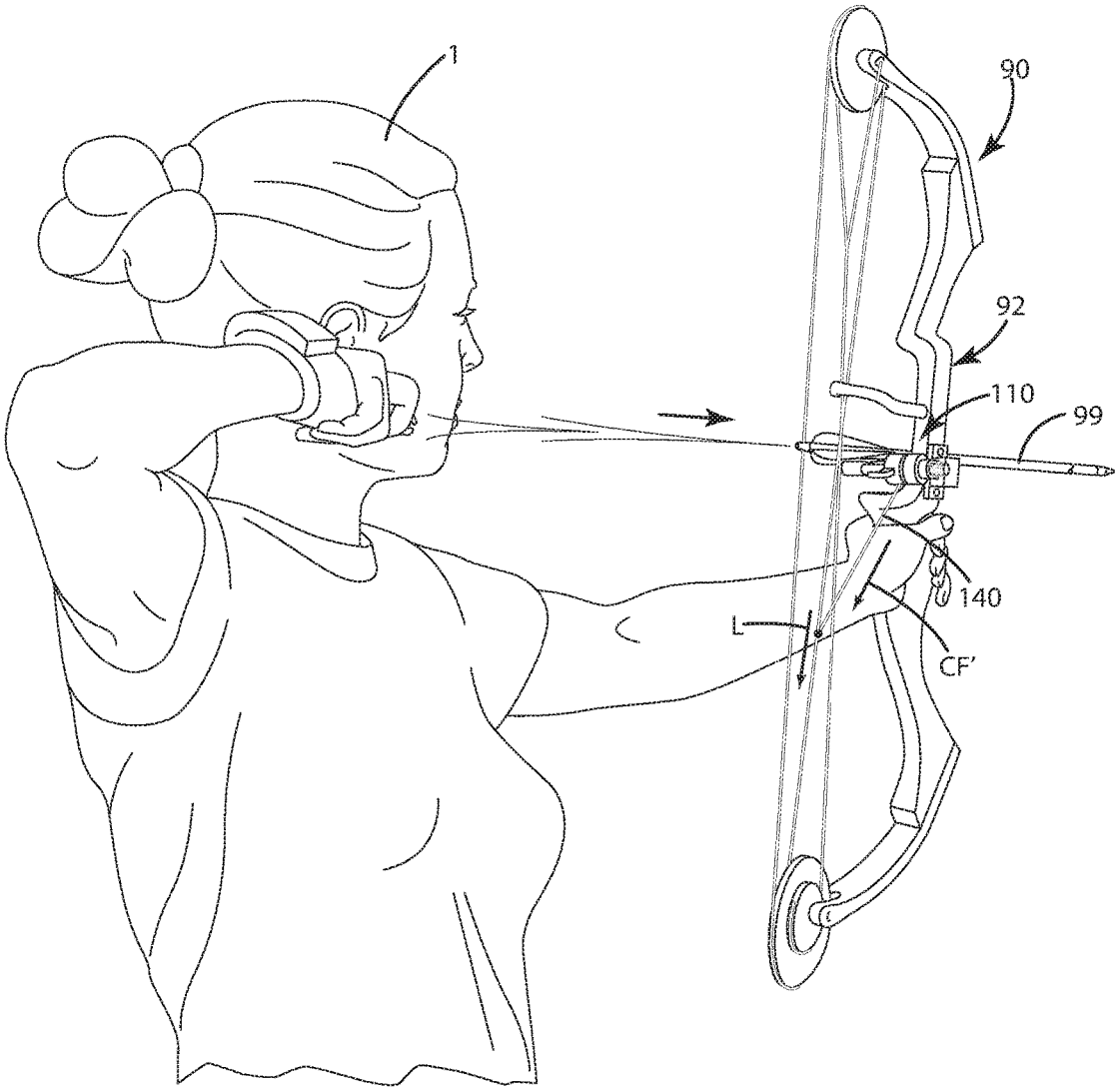
FIG. 8 is a perspective view of an archery bow released, with the arrow rest of the first alternative embodiment moving to a rest position.

A first alternative embodiment of an arrow rest mounted to an archery bow is illustrated in FIGS. 6-9 and generally designated 110. The arrow rest 110 there is similar in structure, function and operation to that of the embodiment described above, with several exceptions. For example, the first magnetic element 131 is constructed and arranged so that it can hold the support arm 120 in the support position as shown in FIG. 7 and generally urges the support arm into that position when there is no cord force CF being transferred to the rest by the cord 140. In this construction, the optional biasing element 150 in can assist the first magnetic element 131 and supplement the predetermined force PF2 exerted by the coded magnet 133 to hold or urge the support arm 120 into the support position shown in FIG. 7.

With this type of arrangement, the connector 140 can be attached to the up cable 94. Thus, when the bow is drawn, the tension in the connector 140 is decreased. Thus, the connector 140 exerts little or no cord force on the first magnetic element 131, the support arm 120 and/or the axle 122. The support arm 120 continues to stay in the support position due to the magnetic predetermined force PF2 exerted thereon, and the optional biasing member forces as well.

Figure 9:
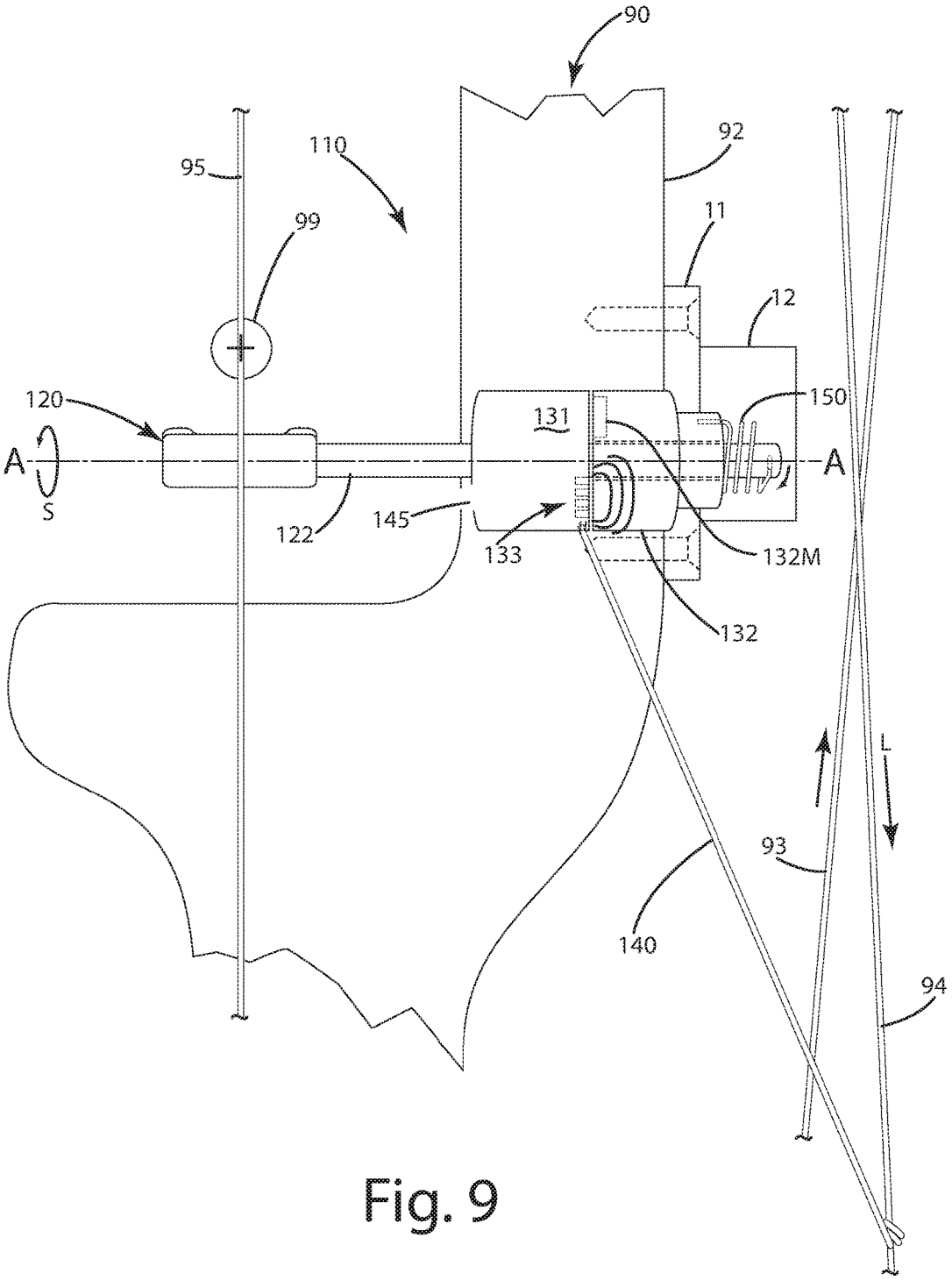
FIG. 9 is a rear perspective view of the arrow rest of the first alternative embodiment when the bow is released.

When the bowstring is released, tension in the connector 140 attached to the power cable 94 is drawn taut due to the downward movement in direction L of the power cable 94. The tension in the connector 140 attached to the power cable increases, thereby generating a cord force CF' on the rest. This in turn exerts a rotational force that overcomes the predetermined force PF2 of the coded magnet 133 in the first magnetic element 133, as well as any optional biasing force generated by the coil spring 150. In turn, the support arm 120 is rotated about the rest axis A in direction M to the rest position as shown in FIG. 9. This ensures that the support arm 120 is clear of the arrow 99 and its fletchings as the arrow is launched from the bow.

Figure 10:
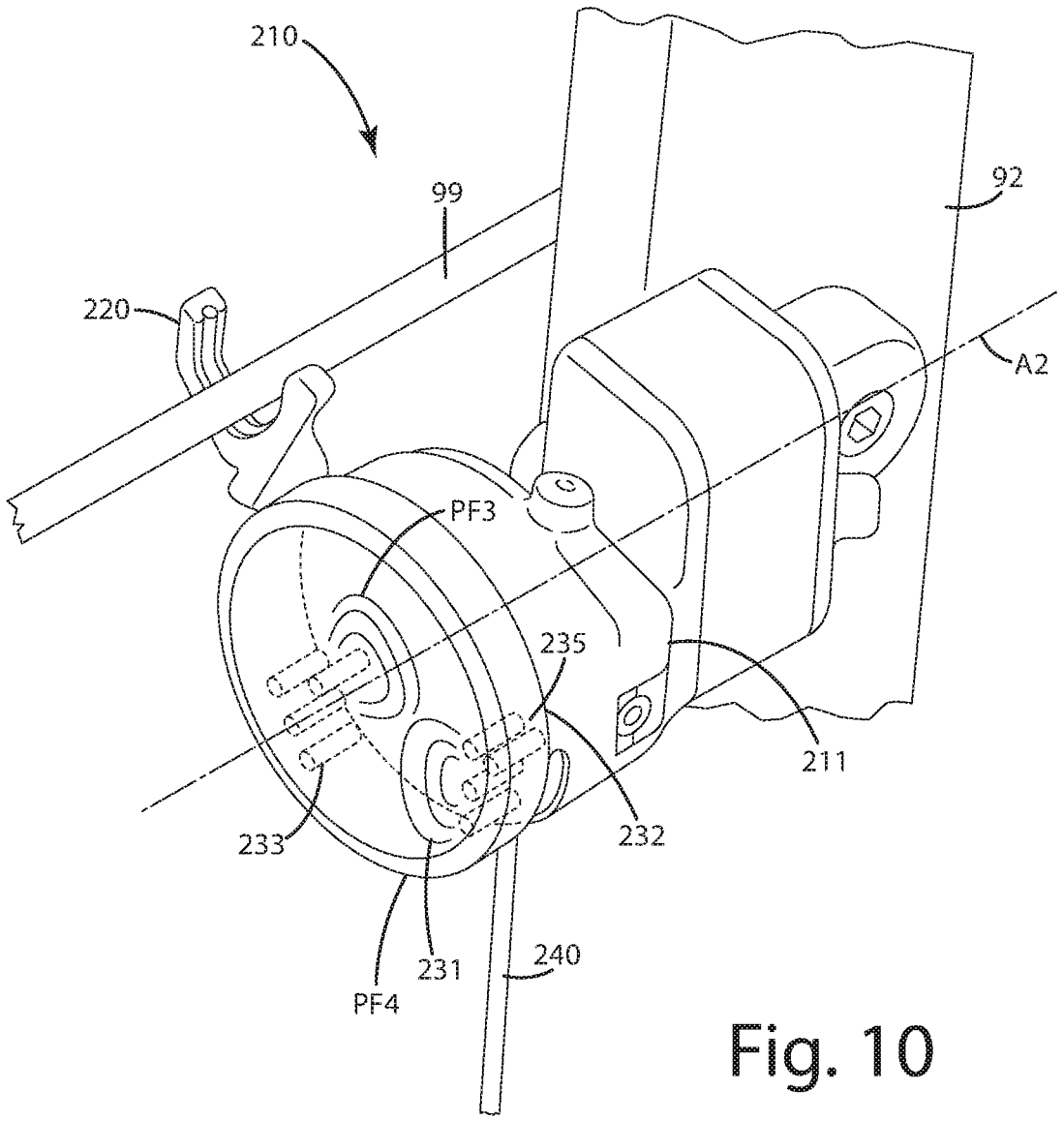
FIG. 10 is a rear perspective view of an arrow rest of a second alternative embodiment that rotates about a C axis that is parallel to an arrow when mounted on a support arm of the arrow rest.

A second alternative embodiment of the arrow rest is shown in FIG. 10 and generally designated 210. This construction is similar in structure, function and operation to the embodiments described above with several exceptions. For example, this arrow rest 210 is referred to as a C axis arrow rest, the type of which is disclosed in U.S. Pat. No. 7,597,095 to Grace and U.S. patent application Ser. No. 14/146,312 to Grace filed Jan. 2, 2014, both of which are incorporated by reference herein their entirety. The arrow rest 10 is configured with a support arm 220 that rotates about a rest axis A2 which is generally parallel to an arrow 99 when it is supported in a support position as shown in FIG. 10. This rest includes a first magnetic element 231 that is associated with a support arm 220. The support arm 220 can be non-rotationally and fixedly joined with the first magnetic element 231. This first magnetic element 231 can be in the form of a plate or other rotatable element that is mounted to an axle or other shaft that is coincident with the rest axis A2 but not shown for clarity in the figures. The first magnetic element 231 can include a first coded magnet 233 of the type described above. This first coded magnet can exert a predetermined force PF3 as illustrated in FIG. 10. The first magnetic element can be mounted via a connector or cord 240 of the type described above to a bow component such as a limb or power cable. Optionally, the connector can be joined with an up power cable.

The rest 10 also can include a second magnetic element 232, which can be joined with the housing 211 of the rest 210 and adapted to be mounted in a fixed orientation relative to the archery bow 92. Optionally, the second magnetic element 232 does not rotate in unison with the support arm and can be held in a generally fixed position. The second magnetic element 232 can include a second coded magnet having a second fixed plurality of maxels having individual polarities and strengths. This second coded magnet 235 can emit a second magnetic field profile from the second magnetic element. This second magnetic field profile can exert a predetermined force PF4 that is similar to the predetermined force PF3 of the first coded magnet 233.

Figure 11:
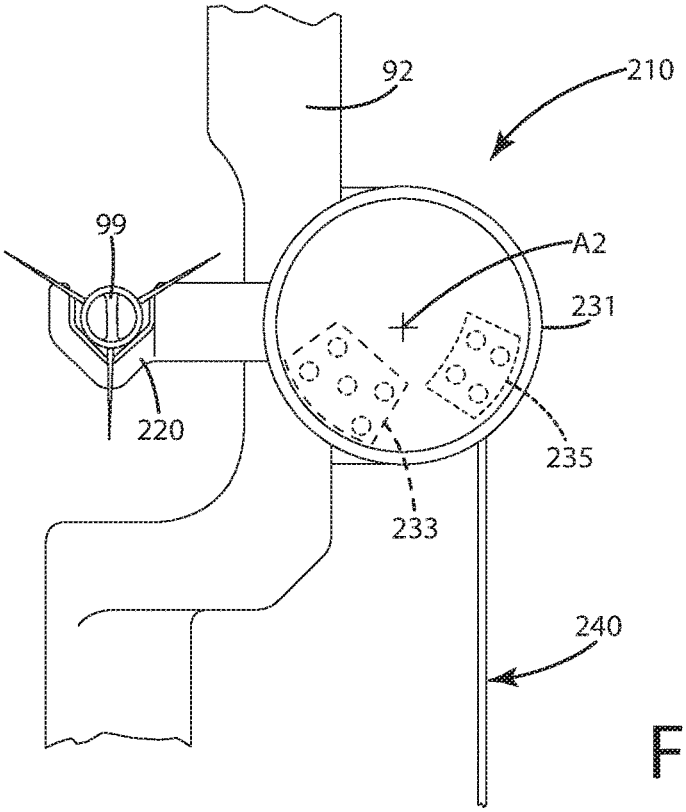
FIG. 11 is a rear view of the arrow rest of the second alternative embodiment with misaligned magnetic elements when the archery bow is fully drawn.
Figure 12:
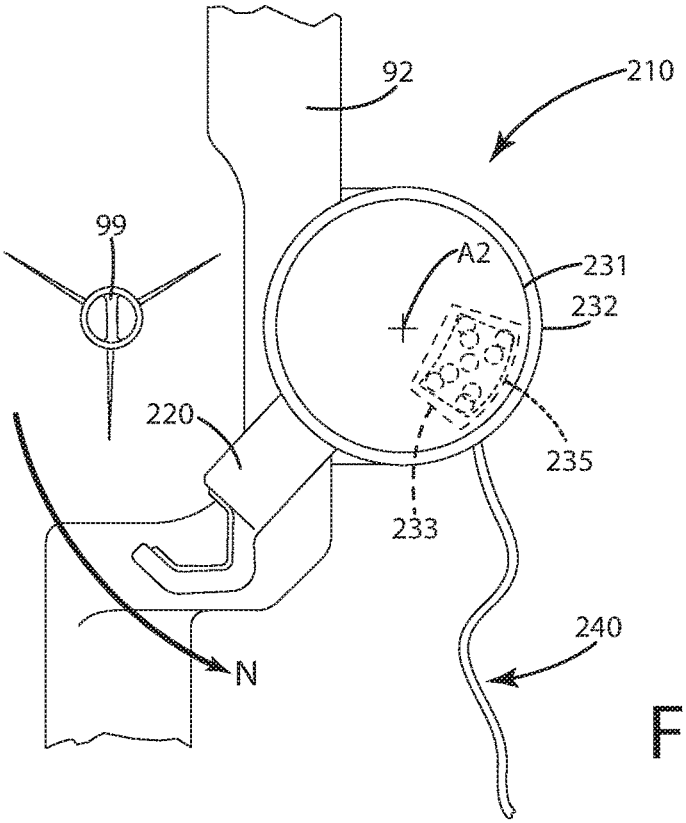
FIG. 12 is a rear perspective view of the support arm of the arrow rest of the second alternative embodiment converting from a support position to a rest position, with the magnetic elements exerting a predetermined force on the support arm to rotate it.

In the configuration shown in FIGS. 10 and 11, the coded magnets 233 and 235 of the respective first and second magnetic elements are offset or rotationally displaced from one another. They are in this orientation initially while the cord 240 is taut and the support arm 220 is in the up position. This can be achieved while the bow is in the brace or undrawn mode, and even when the bow is drawn, depending on the configuration. When the bow is shot, as shown in FIG. 12, the cord 240 becomes slack, the first magnetic field profile and the second magnetic field profile exert their respective predetermined forces PF3 and PF4 to attract to one another spatially. In turn, this urges the arrow support arm, fixedly attached to the first magnetic element, downward in the direction N. The first and second coded magnets are configured to align with one another due to the respective first and second magnetic field profiles emitted from those coded magnets. Thus, when the rest attains the position shown in FIG. 12, the first maxels and the second maxels of the respective first and second coded magnets are aligned with one another.

Optionally, in any of the embodiments herein, where first and second magnetic elements include respective first and second coded magnets, the first and second coded magnets can cooperatively exert a predetermined force on the support arm when those coded magnets are in a predetermined orientation relative to one another. This, in turn, urges the support arm either toward the support position or toward the rest position depending on the desired movement and orientation of the coded magnets. Generally, the respective magnetic elements and coded magnets can be selectively locatable within the other's magnetic field profile.

Figure 13:
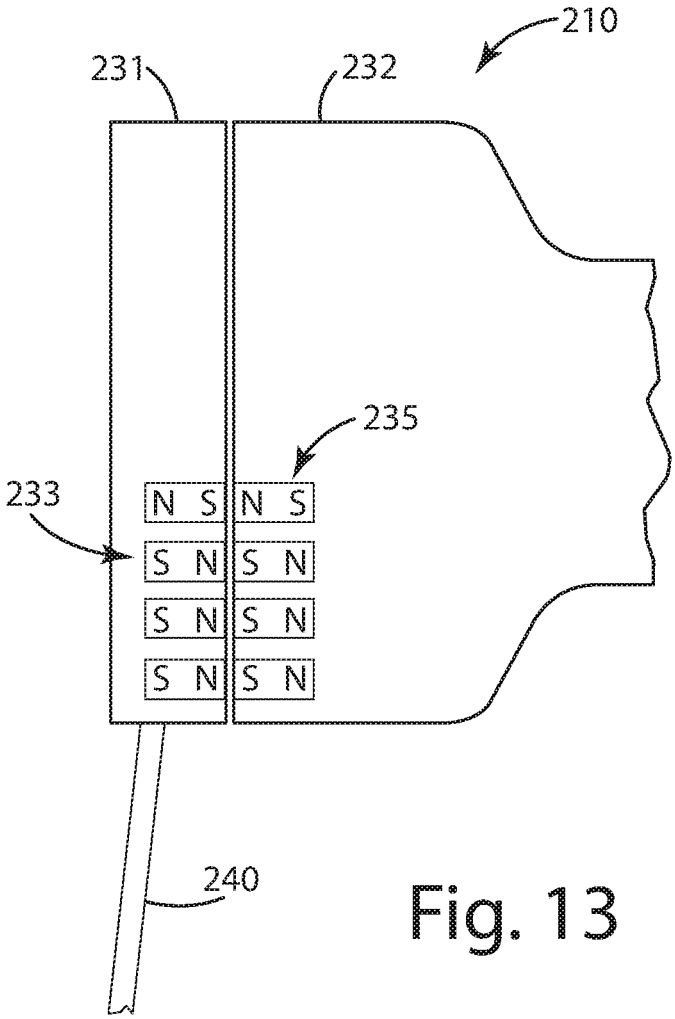
FIG. 13 is a side perspective view illustrating first and second magnetic elements of the arrow rest having mirrored maxels of the respective coded magnets of the second alternative embodiment.

Optionally, in constructions where the first and second magnets include coded magnets and maxels, for example, to facilitate the magnets aligning with one another in a predetermined orientation, the respective maxels of each coded magnet can include polarities and intensities mirroring the polarities and intensities of the maxels of the other coded magnet. This mirrored polarity and intensity is illustrated in FIG. 13, where the first coded magnet 233 and the second coded magnet 235 are aligned with one another when the arrow support is in the position as illustrated.

Figure 14:
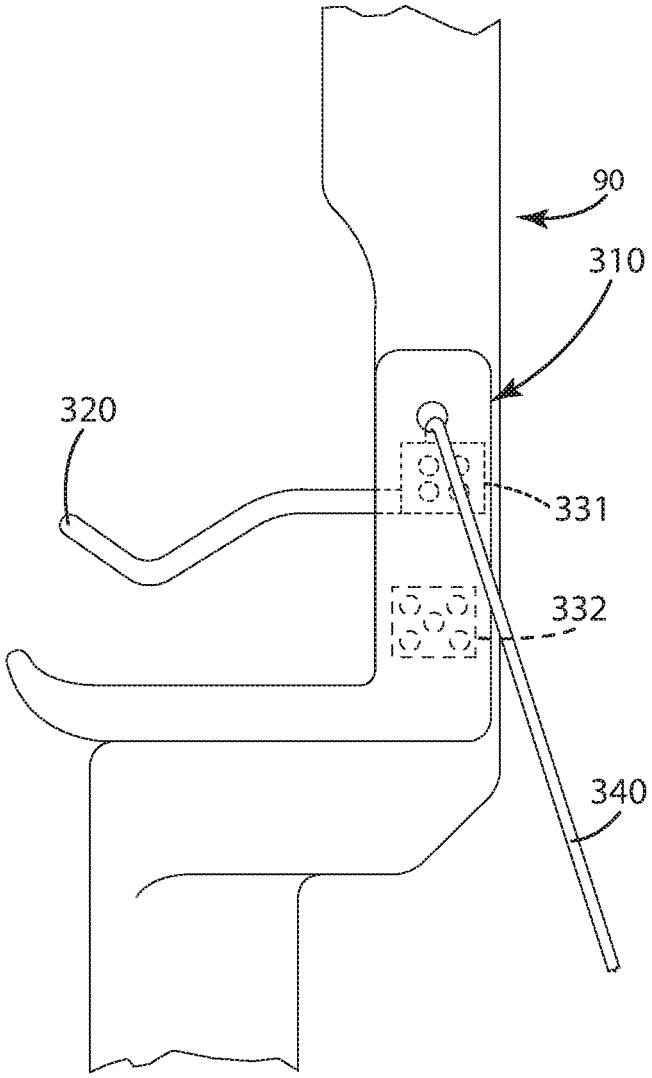
FIG. 14 is a rear perspective of a linear dropping arrow rest of a third alternative embodiment associated when an archery bow is fully drawn.
Figure 15:
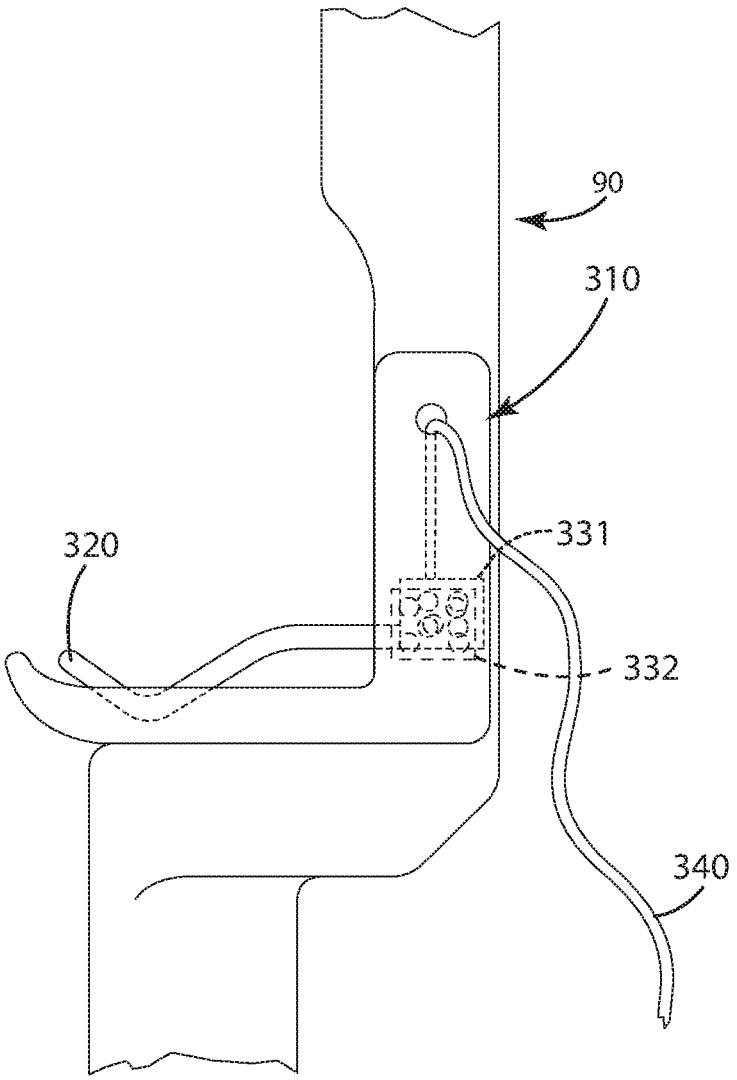
FIG. 15 is a rear perspective view of the linear dropping arrow rest of the third alternative embodiment when the archery bow is released, and the magnetic elements exert a predetermined force to move the support arm to a rest position.

A third alternative embodiment of the arrow rest is illustrated in FIGS. 14 and 15 and generally designated 310. The construction is similar in structure, function and operation to the embodiments described above, with several exceptions. For example, the rest 310 is a vertically dropping rest, of the type that drops a linearly or vertically, for example, as disclosed in U.S. Pat. No. 7,311,099 to Rager, which is hereby incorporated by reference in its entirety. In particular, the rest 310 can include a support 320 which is shown in FIG. 14 in a support position and shown in FIG. 15 in a rest position. The support arm 320 can be mounted fixedly to a first magnetic element 331 including a first coded magnet of the type described above. A second coded magnet incorporated into a second magnetic element 332 can be disposed below or distal from the first magnet when the support arm 320 is in the support position shown in FIG. 14. The support arm 320 can be held in this position shown in FIG. 14 via the connector 340. The connector 340 can be joined with any other bow component which allows it to hold or exert a cord force on the support arm to hold it in a support position. When the cord 340 is put under less tension or the tension therein is eliminated, the first magnetic element 331 and related fixed coded magnet exert a magnetic predetermined force so that it is drawn into close proximity to the second magnetic element 332.

Optionally, the particular magnetic elements can be specifically coded and programmed, with regard to their respective polarities and intensities, to rapidly attract and thereby draw the magnetic elements closer to one another, optionally without physically contacting the magnets with one another. In turn, the associated support arm 320 can drop rapidly out of the way of the arrow that is supported on the support arm, falling to the rest position shown in FIG. 15.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A drop away arrow rest for an archery bow, the bow including a bowstring, the rest comprising:

a bracket configured to attach to a bow;

an arrow support arm distal from the bracket, the arrow support arm movable from a support position to a rest position, a first magnetic element including a first fixed coded magnet having a first fixed plurality of maxels having individual polarities and strengths, and cooperatively emitting a first magnetic field profile from the first magnetic element;

a second magnetic element disposed adjacent the first magnetic element and selectively locatable within the first magnetic field profile, wherein one of the first magnetic element and the second magnetic element is joined with the arrow support arm, and the other of the first magnetic element and the second magnetic element is joined with the bracket, wherein the first magnetic element exerts the first magnetic field profile on the second magnetic element to at least one of position the arrow support arm in the support position when the bow is drawn, and to position the arrow support arm in the rest position when the bow is released, whereby the first fixed coded magnet selectively assists in moving the arrow support arm to either support the arrow when the bow is drawn, or move out of the way of the arrow when the arrow is launched from the bow.

2. The drop away arrow rest of claim 1 comprising an axle to which the arrow support arm is mounted, wherein the arrow support arm and axle are rotatable about the rest axis.

3. The drop away arrow rest of claim 2 comprising:

a connector joined with at least one of the first magnetic element and the second magnetic element; and a bow component so that upon movement of the bow component, at least one of the first magnetic element and the second magnetic element rotates relative to the other, thereby causing the arrow support arm to move relative to the bracket.

4. The drop away arrow rest of claim 3, wherein the second magnetic element is constructed from a ferromagnetic material void of any magnets, wherein the first coded magnet exerts a predetermined force on the arrow support arm when the ferrous material is in a predetermined spatial relationship with the first coded magnet.

5. The drop away arrow rest of claim 1, wherein the second magnetic element includes a second fixed coded magnet having a second fixed plurality of maxels having individual polarities and strengths, and cooperatively emitting a second magnetic field profile from the second magnetic element, wherein the first magnetic field profile and the second magnetic field profile exert a combined predetermined force on the arrow support arm when the first maxels and the second maxels are aligned.

6. The drop away arrow rest of claim 1, wherein the arrow support arm is movable within a substantially vertical plane, wherein the first magnetic element is configured to urge the arrow support arm from the support position, linearly and vertically downward, to the rest position when the first magnetic element becomes physically misaligned with the second magnetic element.

7. The drop away arrow rest of claim 1 comprising:

a lever adjacent the bracket and distal from the support arm, wherein the lever is manually actuatable to move the arrow support arm from the rest position to the support position, wherein in the support position, the first magnetic field profile maintains the arrow support arm in the support position.

8. The drop away arrow rest of claim 1 comprising a coil spring joined with the support arm, the coil spring urging the support arm toward at least one of the support position and the rest position.

9. The drop away arrow rest of claim 1 wherein the support arm rotates about a rest axis that is generally parallel to an axis of an arrow when the arrow is supported by the arrow support arm in the support position.

10. A drop away arrow rest for an archery bow, the bow including a bowstring, the rest comprising:

a bracket configured to attach to the bow;

an axle projecting laterally away from the bracket toward a plane in which the bowstring moves;

an arrow support arm fixedly joined with the axle and disposed within the bowstring plane, the arrow support arm movable from a support position to a rest position about a rest axis;

a first magnetic element including a first fixed coded magnet having a first fixed plurality of maxels having individual polarities and strengths, and cooperatively emitting a first magnetic field profile from the first magnetic element; and a second magnetic element including a second coded magnet correlated with the first fixed coded magnet, the first and second coded magnets cooperatively exerting a predetermined force on the support arm when the second coded magnet is disposed in a predetermined orientation relative to the fixed coded magnet so as to urge the support arm toward either the support position or the rest position, the second magnetic element disposed adjacent the first magnetic element and selectively locatable within the first magnetic field profile, wherein one of the first magnetic element and the second magnetic element is joined with the axle, and the other of the first magnetic element and the second magnetic element is joined with the bracket.

11. The drop away arrow rest of claim 10 wherein the rest axis is substantially perpendicular to an axis of an arrow supported on the arrow support arm when the arrow support arm is in the support position.

12. The drop away arrow rest of claim 10 comprising a coil spring joined with at least one of the axle and the bracket, the coil spring urging the arrow support arm toward at least one of the support position and the rest position.

13. The drop away arrow rest of claim 12 wherein the coil spring urges the arrow support arm in a direction opposite that which the predetermined force urges the arrow support arm.

14. The drop away arrow rest of claim 10 wherein the second magnet element comprises a second plurality of maxels presenting polarities mirroring the polarities of the first fixed plurality of maxels.

15. The drop away arrow rest of claim 10 comprising a cord adapted for attachment to a bow component, the cord adapted to selectively exert a cord force that counters the predetermined force.

16. A drop away arrow rest for an archery bow, the bow including a bowstring, the rest comprising:

a bracket configured to attach to the bow;

an arrow support arm distal from and movable relative to the bracket, the arrow support arm movable from a support position to a rest position, a first magnetic element including a first fixed coded magnet having a first fixed plurality of maxels having individual polarities and strengths, and cooperatively emitting a first magnetic field profile from the first magnetic element;

a second magnetic element disposed adjacent the first magnetic element and selectively locatable within the first magnetic field profile, wherein the first fixed coded magnet is configured to exert a predetermined force on the arrow support arm to hold the arrow support arm in the support position or the rest position, when the second magnetic element is disposed in a predetermined orientation relative to the first fixed coded magnet.

17. The drop away arrow rest of claim 16, wherein the first magnetic element and the second magnetic element are spaced from one another and do not contact one another in either of the support position or the rest position.

18. The drop away arrow rest of claim 16 comprising:

a rest axis about which the arrow support arm is rotatable, wherein the rest axis is substantially perpendicular to an axis of an arrow supported on the support arm when the arrow support arm is in the support position.

19. The drop away arrow rest of claim 16 wherein the arrow support arm rotates about a rest axis that is generally parallel to an axis of an arrow when the arrow is supported by the arrow support arm in the support position.

20. The drop away arrow rest of claim 16 wherein the support arm is movable within a substantially vertical plane, wherein the first magnetic element is configured to urge the support arm with the predetermined force from the support position vertically, but non-rotatably, downward to the rest position when the first magnetic field profile becomes misaligned with the second magnetic element.

* * * * *